US010006241B2

(12) United States Patent
Tusk

(10) Patent No.: US 10,006,241 B2
(45) Date of Patent: Jun. 26, 2018

(54) CABINET DOOR SYSTEM WITH REMOVABLE EXPOSED SURFACES

(71) Applicant: Moshe Tusk, Far Rockaway, NY (US)

(72) Inventor: Moshe Tusk, Far Rockaway, NY (US)

( * ) Notice: Subject to any disclaimer, the term of this patent is extended or adjusted under 35 U.S.C. 154(b) by 0 days. days.

(21) Appl. No.: 15/158,580

(22) Filed: May 18, 2016

(65) Prior Publication Data

US 2016/0340965 A1 Nov. 24, 2016

Related U.S. Application Data

(63) Continuation-in-part of application No. 13/848,309, filed on Mar. 21, 2013, now abandoned.

(60) Provisional application No. 62/233,393, filed on Sep. 27, 2015.

(51) Int. Cl.

| | |
|---|---|
| ***A47G 29/00*** | (2006.01) |
| ***E06B 3/72*** | (2006.01) |
| ***A47B 96/20*** | (2006.01) |
| ***A47B 47/00*** | (2006.01) |
| ***A47B 96/14*** | (2006.01) |
| *A47B 77/00* | (2006.01) |
| *E06B 3/70* | (2006.01) |
| *E06B 5/00* | (2006.01) |

(52) U.S. Cl.

CPC ..... *E06B 3/721* (2013.01); *A47B 47/0041* (2013.01); *A47B 96/145* (2013.01); *A47B 96/201* (2013.01); *A47B 77/00* (2013.01); *A47B 96/1466* (2013.01); *A47B 2096/207* (2013.01); *E06B 3/7001* (2013.01); *E06B 5/006* (2013.01); *Y10T 29/49826* (2015.01)

(58) Field of Classification Search

CPC ..... A47B 47/05
USPC ..... 312/257.1, 263, 264, 265.1–265.4, 265.6
See application file for complete search history.

(56) References Cited

U.S. PATENT DOCUMENTS

| | | | |
|---|---|---|---|
| 3,296,745 | A | 1/1967 | Johnson et al. |
| 3,877,765 | A | 4/1975 | Hassing |
| 4,114,341 | A | 9/1978 | Vincens |
| 4,415,236 | A | 11/1983 | Perregaux |
| 6,053,585 | A | 4/2000 | Osen |
| 7,078,085 | B2 | 7/2006 | Nykamp et al. |
| 7,207,636 | B2 | 4/2007 | Livingston et al. |
| 7,387,151 | B1 | 6/2008 | Payne |

*Primary Examiner* — Matthew W Ing
(74) *Attorney, Agent, or Firm* — IM Law Group PC; Leora Meystelman

(57) ABSTRACT

A panel set system and storage system is provided having faces which can be easily interchanged, creating a new look for the furniture and even the whole rooms The new decor is easily accomplished at reasonable prices the average homeowner can afford.

14 Claims, 5 Drawing Sheets

CABINET DOOR SYSTEM WITH REMOVABLE EXPOSED SURFACES

CROSS-REFERENCE TO RELATED APPLICATIONS

This application claims priority from U.S. Provisional Patent Application Ser. No. 62,233,393 filed Sep. 27, 2015, which is incorporated herein by reference.

This application is a Continuation-in-Part Application of U.S. utility patent application Ser. No. 13/848,309, filed Mar. 21, 2013, which is incorporated herein by reference.

FIELD OF THE DISCLOSURE

The present disclosure relates to the field of storage systems, doors, and other furniture. More particularly, the disclosure relates to a storage system and related method for interchanging an exposed furniture surface of the storage system.

BACKGROUND

Many people enjoy redecorating rooms in their homes and businesses. However, redecorating can become expensive, tedious and time consuming, especially to the extent storage systems are replaced in the remodeling process. Many storage systems such as cabinets and drawers are custom made and have unique dimensions. Hence, redecorating that includes creating a new custom made storage system having, for example, cabinets, drawers and shelves for a kitchen may involve a steep expense. In addition, the remodeling may require disassembling the original storage system and building a new storage system using specialized tools. This endeavor takes time, disrupting the lives and/or businesses of those who use the room occupied by the storage system.

Often, once a cabinet system is installed in a home, they cannot be changed without completely remodeling the kitchen, requiring the homeowner to throw out or somehow recycle the existing cabinet system. During the conventional remodeling process, a homeowner is typically left without a functioning kitchen for weeks, and usually months. Kitchen management firms often devote a large portion of their project management time and efforts to post delivery punch list items, such as getting replacement parts for items damaged on site or missing from delivery, which causes completion delays and frustrates both the retailers' staff and their clients. Even if the end result of the remodeling is a pleasing and correct design, the heartache, and frustration, and waiting may leave a bitter taste, coloring the whole felt experience of the remodeling process.

SUMMARY

The present disclosure is directed to a cabinet door system comprising a modular frame that includes a plurality of legs. Each leg of the plurality of legs has opposing ends, a first channel, a second channel, and a lip extending longitudinally along a whole length of each frame leg, between said opposing ends of each leg. The cabinet door system additionally comprises a removable panel having a front, exterior face, and an opposing back, or interior face. The panel has four sides corresponding to each respective leg and edges along the perimeter of each of said four sides. Each edge of said panel is positioned within the first channel of a corresponding respective leg. The first channel is sized and recessed to accommodate the removable panel.

The door system includes a plurality of clips that are coupled to the removable panel. Each of the clips is positioned within the second channel of the respective legs, which second channel is recessed to accommodate each clip. A fastener removably couples each clip to each second channel of a respective leg.

The frame's lip extends from the back, or interior face to the front, or exterior face of the pane. The lip additionally extends a width of the thickness of the panel and conceals the panel's edges so that at least a portion of the lip is exposed and is flush with front, exterior face of the panel.

Each leg of the cabinet door includes a first shallow channel, and a second deeper channel, contained within said first channel. Each leg of the modular frame comprises a hole on a side of the frame opposite and corresponding to the second channel of the leg. The terms modular frame used herein is hereby defined as a frame constructed of standard units. The panel's dimensions, for example, height, width and thickness, are configured to cooperate with the frame.

Each clip can be coupled to the removable panel with an adhesive such as glue or tape, or coupled to the panel mechanically with a fastener such as a screw. The first channel of the frame can have a height and a width, such that at least one of said height or width of the first channel exceeds either the height or width of the removable panel by a predetermined amount. In one embodiment, the first channel can have a height and a width, such that at least one of its height or width exceeds either the height or width of the removable panel by a tolerance of 0.125 of an inch to allow for the removal of the panel from said first channel.

The second channel has a height and a width, such at least one of said height or width of the second channel exceeds either the height or width of the clip by a predetermined amount. In one embodiment the second channel has a height and a width, and at least one of said height or width of said second channel exceeds either the height or width of the clip by a tolerance of 0.03125 of an inch to allow for the removal of the clip from the second channel. The first channel encompasses a width, length, and depth of the second channel, such that the second channel's dimensions are situated within a width, length, and depth of the first channel.

In one embodiment, the plurality of legs of the cabinet door system comprises four legs. In an embodiment, the plurality of legs form a parallelogram when assembled, coupled to one another via corner brackets and screws at each corner to enclose a removable panel.

The front face of the panel and a portion of the lip that is flush with the front surface of the removable panel are both exposed. Only the front face of the door and the lip that is flush with front face of the panel are exposed when the cabinet door of the cabinet door system is in a closed position, and when viewed head on from the front face. At least a portion of the exposed lip is beveled. The frame lip comprises four surfaces, a first surface touching and flanking the edges of a side of the removable panel, a second opposing top surface, a third front and exposed surface that is flush with front face of the panel, and a fourth beveled side adjoining the opposing top surface of the lip and the front exposed front surface of the lip.

Each frame leg comprises polygonal members defining a hole on an opposing side of each leg such that the hole corresponds and allocates a space for a top cylindrical structure of a screw having threading. The hole defines an opening on the face of the clip opposing the side positioned in the second channel. The threading corresponds to a screw, and the screw's threading, such that the screw fastens the clip into the second channel. The polygonal members define a hole hold a screw in place when said frame legs are assembled and said removable panel is fastened.

BRIEF DESCRIPTION OF THE DRAWINGS

Various embodiments of the present disclosure will be described below with reference to the figures, wherein.

DETAILED DESCRIPTION

Figure 1A:
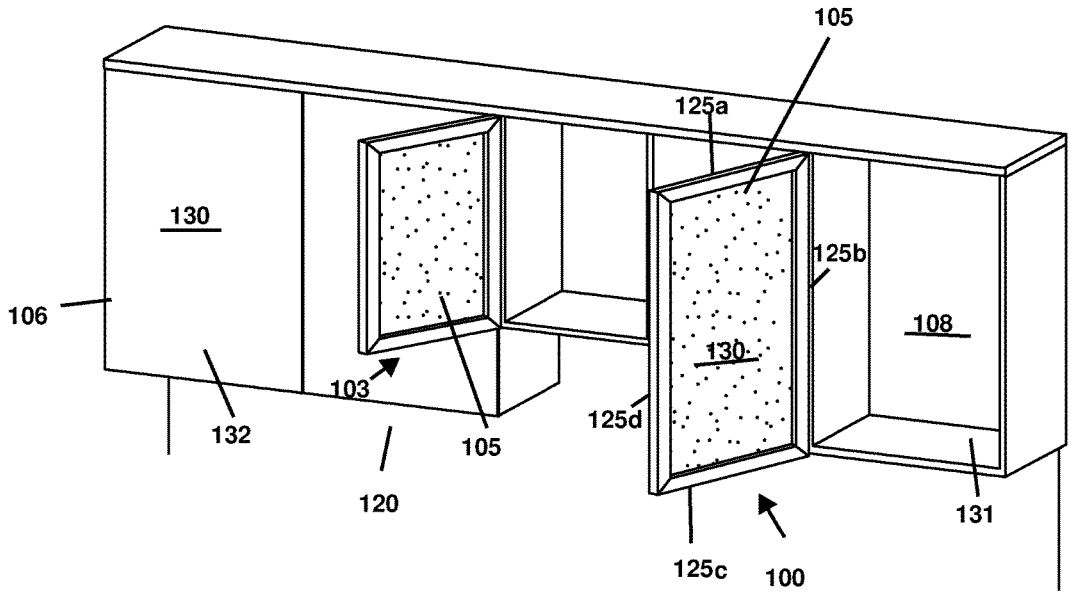
FIG. 1*a* shows a perspective view of an embodiment of a cabinet door system of the present disclosure with some cabinets in an open configuration and some embodiments of cabinets in a closed configuration.

The present disclosure provides an economical way for a home or business owner to change the decor of a storage system while said storage system is still assembled, without disassembling the storage system, and without specialized tools. The present disclosure provides a cabinet door system with replaceable exposed surfaces. The interchangeable feature of the exposed surfaces is not visible from the perspective of a casual viewer, mainly because the unfinished or even finished edges of the interchangeable exposed surfaces are substantially concealed by a frame, providing a finished and professional appearance.

The frame can have a small lip that overlaps and is sufficient to substantially conceal any unfinished edges of a cabinet door system, allowing the frame to be thin and minimally visible. By simply replacing the original exposed surfaces with replacement surfaces having a different design, it may seem to the casual viewer that the whole room was redecorated, and the entire storage system was replaced. The storage system, in accordance with the present disclosure, provides savings in environmental costs by eliminating the need to dispose of an entire storage system when redecorating, minimizing waste and/or using biodegradable materials. Furthermore, the cabinet door system can reduce decorating costs and expands options for redesigning living and working environments.

A storage system vendor may utilize an online tracking system and a shopping for customers to use to replace exposed surfaces of purchased storage systems with new designs. The owner of the storage system may be able to enter a form of identification, such as an order number, onto a storage system vendor's website. Once the vendor website identifies the customer, the customer may view his or her purchased storage system on his or her screen. The customer can then shop for a new design for his or her exposed surfaces by imposing different designs on his or her system viewed on screen.

Referring now to the drawings described in detail below, like reference numerals identify the cabinet door system and identical or corresponding elements in accordance with the present disclosure. With initial reference to FIGS. 1*a* and 1*b*, an exemplary cabinet door system in accordance with the present disclosure is illustrated and is designated generally as cabinet door system 100.

FIG. 1*a* represents a perspective view of an embodiment of a cabinet door storage system 100 with some cabinet doors 100 in an open configuration, and some embodiments of cabinet doors 100 in a closed configuration. An embodiment of the cabinet door system 100 is illustrated in FIG. 1 and shows a cabinet door system 100 having five cabinets. FIG. 1*a* shows the front face 106, defined herein as the exterior side or face 106, of cabinet doors 100 in a closed configuration. The back face 105, defined herein as the interior side or face 105, of the doors is shown in an open configuration of the cabinet door system 100. A panel 130 is shown in the cabinet door system 100, enclosed by the frame 103. The interior side 105 of the door shows a modular frame 103, constructed of a plurality of legs 125, enclosing the edges of the panel 130. The term "enclose," as used herein, refers to surrounding or encircling cabinet door 100 on four sides. The term "edge" as used herein, refers to the rim or outer boundary forming the border of panel 130.

The panel 130 can be inserted into the frame 103 through the front of the cabinet door system 100, with an interior face 105 of the panel 130 approaching the plurality of frame legs 125 before the panel's exterior face 106, in embodiments of this disclosure. The panel 130 can be seen from both the exterior face 106 in the closed cabinet doors 100 and an interior face 105 of the door panel 130 shown enclosed by frame 103. A storage area 108 can be positioned behind each door as shown in said Figure.

In an embodiment, the door panel 100 can encompass a plurality of materials coupled as one removable panel 130. In one embodiment, a single surface material 132 can compose the removable panel 130. A back or interior face 105 of the panel 130 of the cabinet door system, may be the back face 105 of the surface material 132 of the cabinet door 100, with the exterior, or front face of the surface material 106 visible from the front face 106 of the cabinet door. In another embodiment, the back face 105 of the panel 130 can be a backboard that is coupled to a surface material 132 which would be visible and seen from the exterior, or front face 106 of a cabinet door system 100. The term "panel" as used herein can refer to one sheet of material alone, or one more sheets of material coupled together as a unit.

Figure 1B:
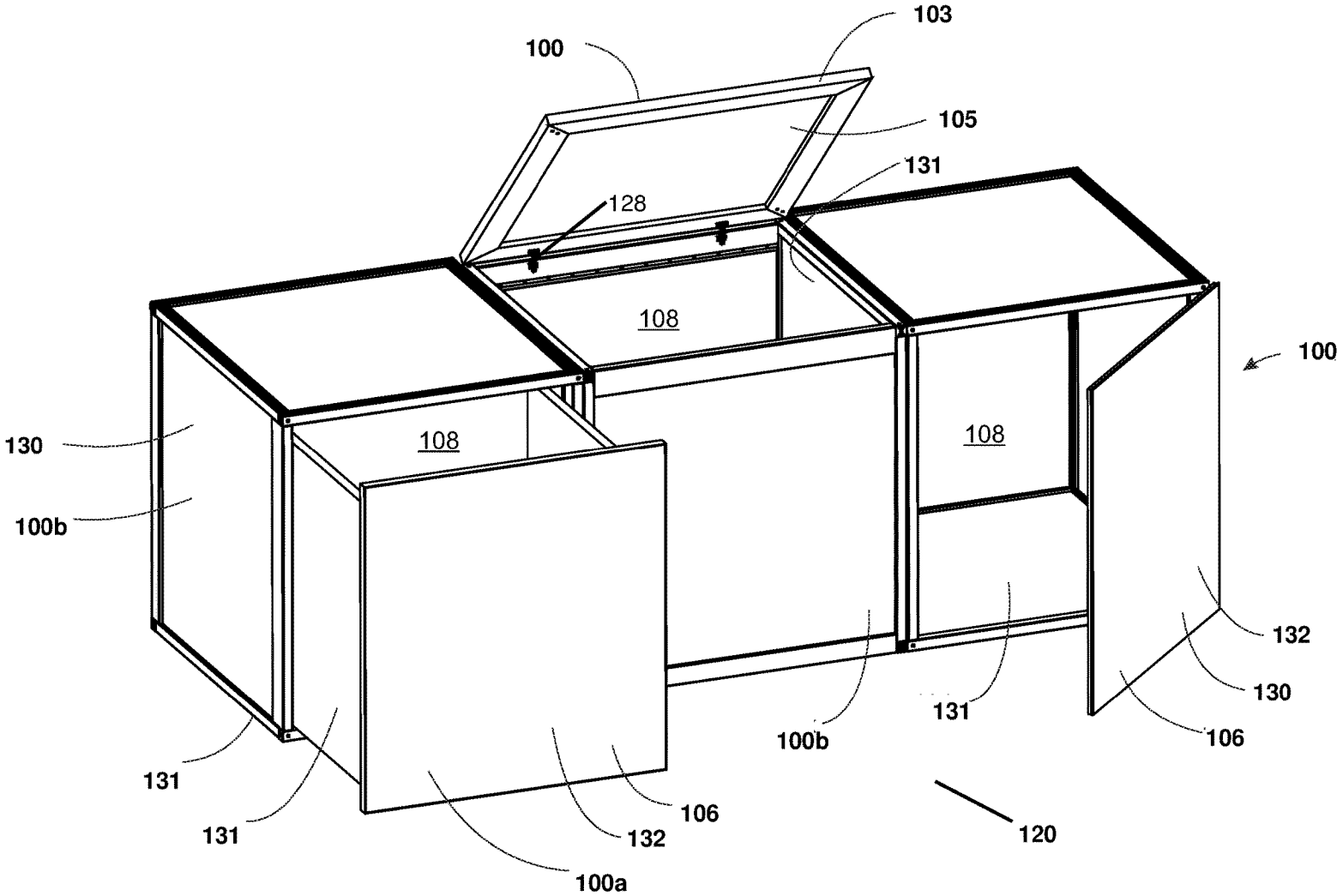
FIG. 1*b* shows a perspective view of an embodiment of a cabinet door system of the present disclosure with cabinets and drawers in an open configuration.

FIG. 1*b* shows embodiments of a cabinet door system 100 with cabinets in a closed and in an open configuration. A storage system can include cabinets as well as drawers. A cabinet door 100 can be configured as a drawer 100*a* that may slidably open and shut, still having a storage area 108 positioned behind the interior of the drawer door 100*a*.

Access to the storage cavity 108 may be gained by, for example, but not limited to, moving a cabinet door 100 from a closed to an open position (such as rotating about on an axis or sliding along a path), or by moving the receptacle itself, e.g., a drawer that can slidably open and shut, as shown in FIG. 1*b*. A cabinet door 100 can be coupled via hinges 128 to a frame 103 framing and encasing the storage area 108 so that the cabinet door 1000 can rotate about hinges 128 to open and close.

A storage system 120 can include cabinets configured as, for example, but not limited to, kitchen cabinets, utility cabinets, office filing cabinets, and stand-alone or built-in furniture (such as used in a bedroom, living room, dining room, and bathroom). A storage system 120 cabinet can stand on a floor surface or, alternatively, may be mounted to a wall, for example, but not limited to, the wall of a building with, e.g., via connectors or a bracket, as is known in the art.

While the exterior faces 106 of cabinet doors may be exposed, outer cabinet walls 100*b* may be exposed as well, and replaceable panels 130 may be used as shown in FIGS. 1*a* and 1*b* to be able to replace those exposed cabinet walls 100*b* as well. Unexposed cabinet walls 131 shown in FIGS. 1*a* and 1*b* are not replaceable, such as a top cabinet wall that may be covered by a countertop, or interior cabinet walls 131 that adjoin two or more cabinets, and are not exposed when those cabinet doors 100 are in a closed position.

Figure 2:
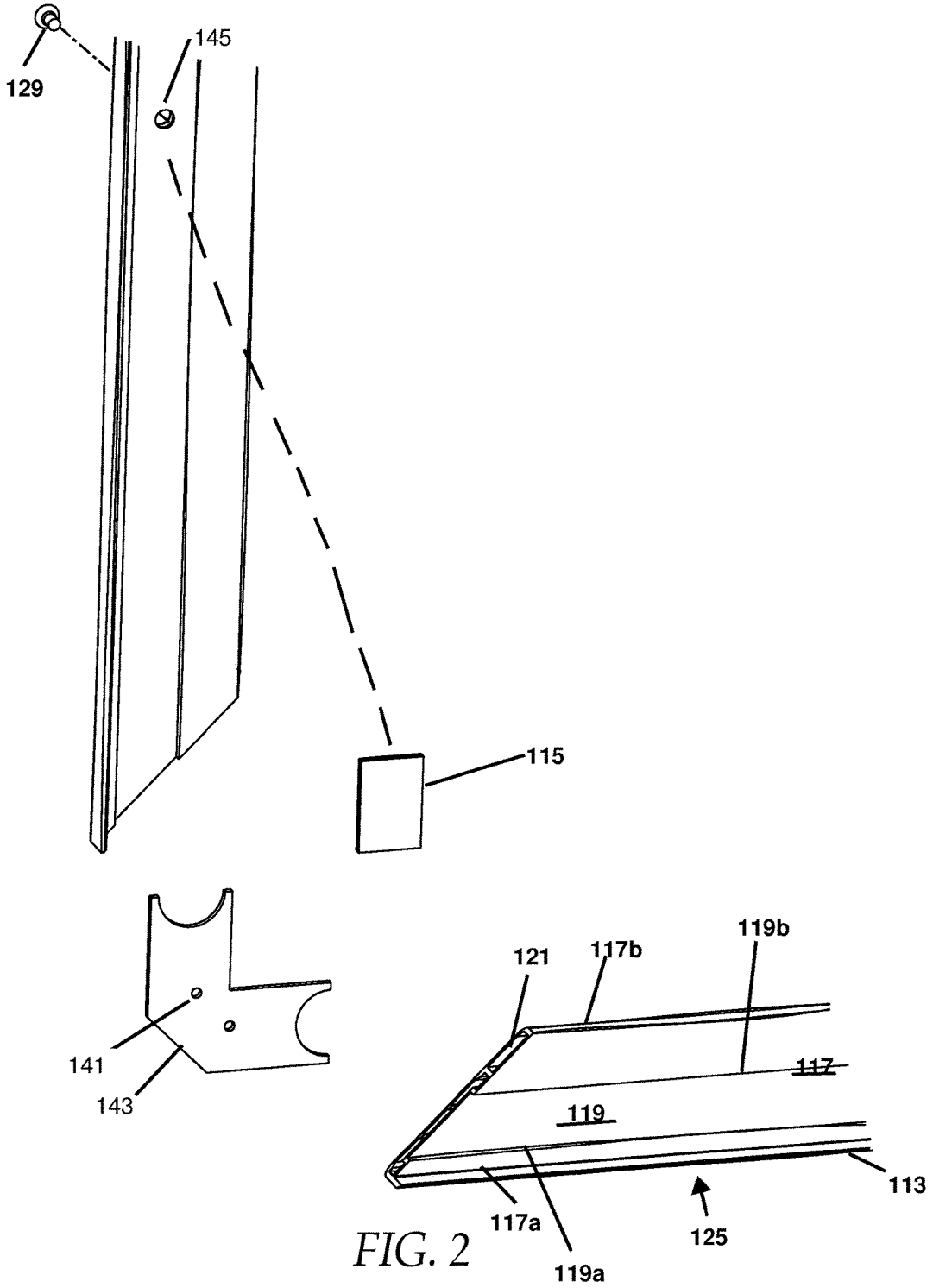
FIG. 2 shows an embodiment of an exploded perspective view of an embodiment of the modular frame of the cabinet door system shown as 125 in FIG. 1.
Figure 4:
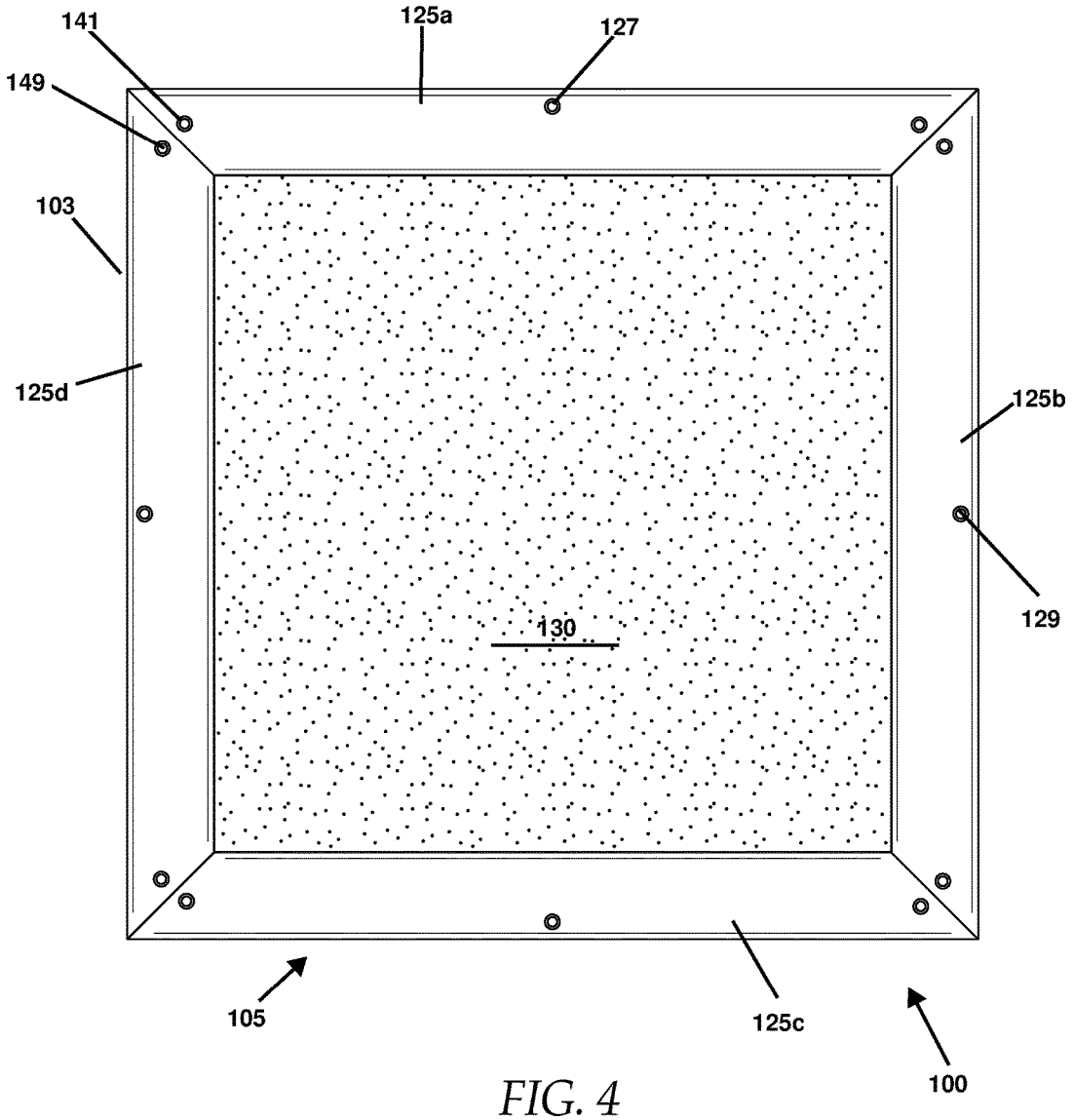
FIG. 4 shows a rear side elevational view of an embodiment of the back face, or interior side of the cabinet door shown as 105 in FIG. 1.

Moving on to FIG. 2, sections of two legs 125 are shown. In one embodiment, legs 125 can be coupled to one another via, for example, but not limited to, dovetail coupling, connectors, or snap-fit, as is known by persons skilled in the art, to enclose panel 130 in frame 103. In one embodiment shown, legs 125 can be coupled to one another via corner brackets 143 and connectors 149 holding the corner brackets 143 in place (connectors 149 are shown in FIG. 4 at the corners of the assembled cabinet door 100) to form the frame 103 as an integral frame 103. The term "integral frame," as used herein, refers to forming a frame 103 as a single unit from one or more parts. The connectors 149 can include, for example, but not limited to, screws, fasteners, bolts, wires, brackets, cables and corner brackets 143. As shown in FIG. 1*a*, leg 125*a* connects with a corner bracket 143 to leg 125*b*, which connects via corner bracket 143 and connectors 149 to leg 125*c*, which connects to leg 125*d*.

Each leg 125 in FIG. 2 is shown having a hollow interior 121, a first channel 117, a second channel 119, and a lip 113. The first channel 117 encompasses a width, length, and depth of said second channel 119 within a width, length, and depth of said first channel. The term "encompasses" as used herein is defined as included within. Each leg 125 has opposing ends, and the first channel 117, the second channel 119, and the lip 113 extend longitudinally along a whole length of each frame leg 125, between said opposing ends of each leg 125. The width of the first channel 117, is shown to extend from 117*a* to 117*b*. The width of the second channel 119 is shown to extend from 119*a* to 119*b*.

Figure 3:
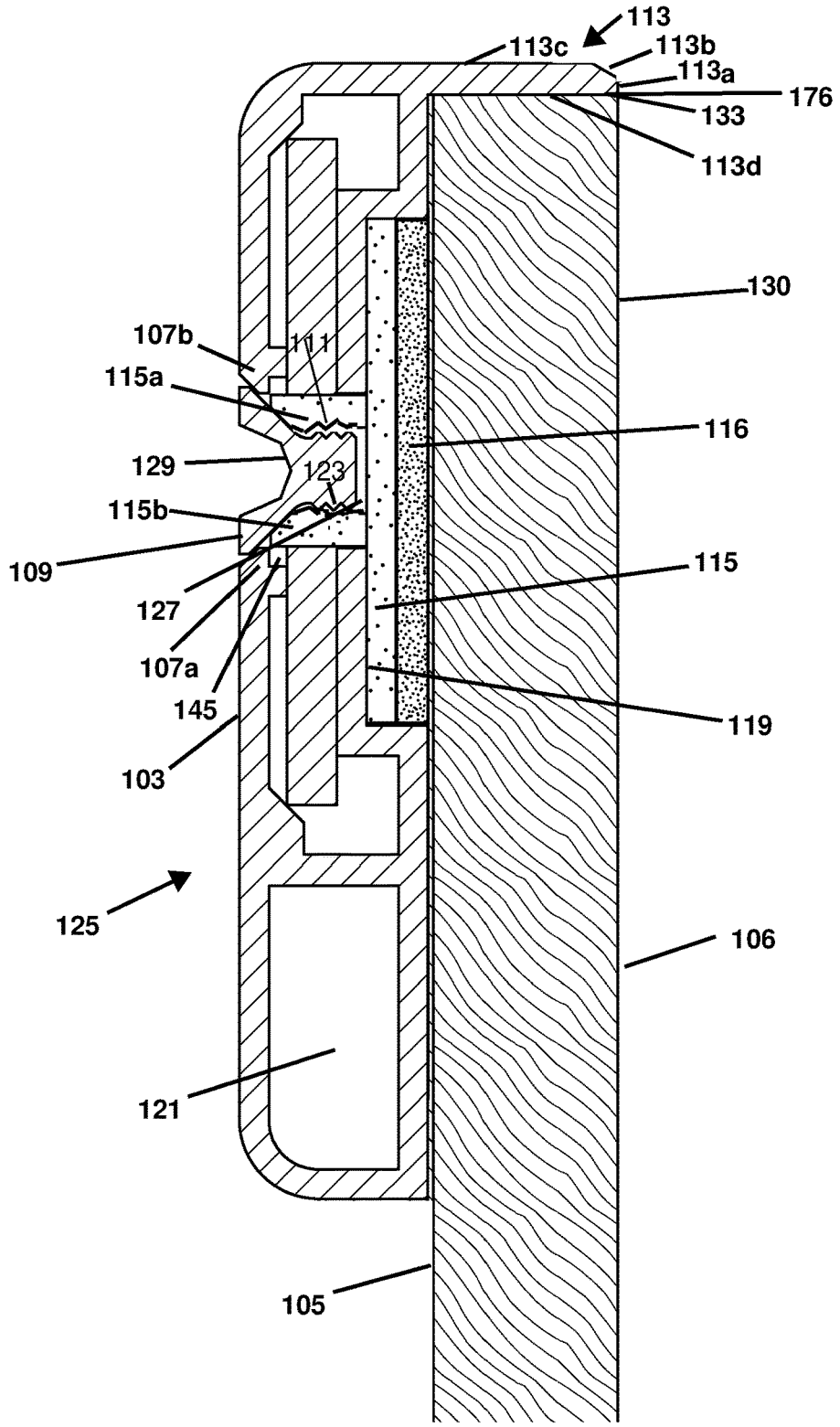
FIG. 3 shows a cross-sectional side view of an embodiment of the cabinet door system shown as 100 in FIG. 1.

A clip 115 is shown, positioned to be placed over a hole 145 in the second channel 119, for the cylindrical top 115*a-b* of the clip 115 to extend through, and so that the clip's hole 127 lines up with the hole 145 in the clip 115 (shown in FIG. 3). Each leg includes at least one hole 145, corresponding to each clip 115. A screw 129 is shown positioned to extend through the same hole 145 in the second channel 119 of each leg 125, from an opposite side and opposing face of the leg 125, and also through the clip's hole 127. Each hole 145 in the frame leg 125 can be at a midpoint of the leg's 125 width and height, or at other placements corresponding to one or more clips 115, in other embodiments.

In one embodiment, each clip 115 may have a length of 1.0 inch, a width of 0.5 inches, and a height of 0.25 inches. In an embodiment, the clip 115 length may extend between 0.5-1.5 inches, the width may extend between 0.25-1 inches, and the height may extend between 0.25-0.75 inches. The second channel 119 may, in embodiments, exceed the clip's 115 dimensions by 0.03125 inches, as the second channel 119 may be sized and recessed to accommodate the clip 115 and its removal from the second channel 119. The depth of the second channel 119 be defined from 0.28125-0.078125 inches.

The first channel 117 is sized and recessed to accommodate the edges 133 of the removable panel 130, and thus having dimensions exceeding the panel 130 edge's 133 dimensions by 0.125 inches. In one embodiment, the panel 130 may have various heights and widths, and the edges 133 having a thickness of 0.375 inches, defining the width of the first channel 117 as 0.5 inches. In embodiments, the first channel 117 may have a width between 0.375 and 1.5 inches, and a depth of between 0.125-0.25 inches. Correspondingly, in one embodiment the lip 113 can extend in width between 0.125-0.25 inches.

Each lip 113 may extend from said back face 105 to said front face 106 of said panel 103, wherein said lip 113 extends a width of a thickness of said panel 103 and conceals the edges 133 of said panel 103. In an embodiment, at least a portion of said lip 113 is exposed and is flush with said front face 105 of said panel 130, without extending any further than the removable panel 130, showing no overhanging lip 113 on its exterior face 106. In another embodiment of the present disclosure, an overhanging lip 113 may extend up to an inch over the panel's 103 front face 106, overlapping onto the front or exterior face 106 of the panel 130 with an "L" shaped profile.

FIG. 3 shows the lip 113 having a plurality of surfaces or edges. In one embodiment, the lip 113 is shown in the Figure as having a first surface 113*d* touching and flanking the edges 133 of a side of the removable panel 103, a second, opposing top surface 113*c*, a third front surface 113*a* that is flush with the front face 106 of the removable panel 130, and a fourth beveled side 113*b* adjoining, said second surface 113*c* and said front surface 113*a* of the lip. The term flanking used herein is hereby defined as bordering closely on a side. The term flush used herein is hereby defined as even and on the same level with, so that no part sticks out higher or lower or protrudes more than the other. The term beveled used herein is hereby defined where the angle or inclination of a line or surface that meets another meets at any angle but 90 degrees The term adjoining used herein is hereby defined as joining and sandwiched between. The lip's 113 front surface 113*a* is exposed and is flush with the removable panel 130 when the cabinet door 100 is in the open position, and in most other configurations and positions of the cabinet door 100.

The panel 130 is shown positioned in the first channel 117 and in embodiments, is lightly held in place by the first channel 117 and the frame lip 113. However, without being fastened into the frame 103 with a screw 129, any slight force may cause the panel 130 to fall out of the frame 103. The first channel 117 of the frame 103 can have a width 117*a*-117*b* (of FIG. 2) that exceeds the width 117*a*-1117*b* of the removable panel 103 by a predetermined amount. In one embodiment, the first channel 117 can have a width 117*a*-117*b*, such that the width 117*a*-117*b* exceeds the width or thickness of the removable panel 103 by a tolerance of 0.125 of an inch to allow for the removal of the panel 103 from the first channel 117.

The tolerance by which the first channel width 117*a*-117*b* exceeds the thickness of the panel 103 forms a gap 176, defined by surface 113*d* of the frame lip 113 and the surface of edges 133 adjacent to surface 113*d*. Gap 176 allows panel 130 to be easily removed from and inserted into replaceable panel 130.

In one embodiment, the lip 113 substantially conceals the edges 133 that define at least two border surfaces of replaceable panel 130. In one embodiment, lip 113 of frame 102 substantially conceals the edges 133 on all four sides of the replaceable panel 130 to the degree that any gap 176 between the frame 103 and replaceable panel 130 is less than or equal to $\frac{1}{8}^{th}$ inch, or 0.125 inches, so that the panel 130 is held in place. The gap 176 is miniscule so that it is impossible for a person to insert his or her finger between panel 130 and lip 113. In one embodiment, the gap 176 may measure $1/32^{nd}$ inch wide. In one embodiment, gap 176 may measure $1/20^{th}$ inch.

The removable panel 130 can be formed of, for example, but not limited to, any one or more of the following: plastic, glass, wood, metal, concrete or a combination thereof. In one embodiment, the thickness of the panel 130 can be minimized in order to preserve the appearance of the removable panel 130. Additionally, minimizing the thickness of the removable panel 130 aids in ease of transport and assembly. The panel 130 may have a thickness in the range of 0.125-1 inches. In one embodiment, the panel may have a thickness of 0.375 inches, 0.25, or 0.5 inches.

In FIG. 3, a clip 115 is shown positioned in the second channel 119, coupled to the back or interior face 105 of the panel 130 with, for example, but not limited to, a glue, adhesive, double sided tape. In other embodiments, the clip 115 may be coupled to the panel 130 using mechanical coupling means, such as connectors or magnet, or any other coupling means known in the art. The clip 115 includes a cylindrical head 115*a-b*. The clip's 115 cylindrical head 115*a-b* are shown extended through the hole 145 in the leg, extending from the second channel 119 through the whole 145 to the opposite side of the leg. A connector 129, such as a screw 129, is shown, the screw 129, having a top 109 fastened through the hole 145. The majority of the screw 129, extends through the hole 127 in the cylindrical top 115*a-b* of the clip 115, fastening the clip 115 into the second channel 119. The screw threading 123 is shown cooperating with the clip's threading 111 situated on the inner surface of the clip's hole 127. The frame leg 125 is shown having polygonal members 107*a-b*, defining a cylindrical hole 145, and retaining the head 109 of connector 129 in holes 145 of the leg 125 and hole 127 of the clip 115. The term polygonal member as used herein refers to a multi-sided part. The hollow parts 121 of the frame leg 125 are seen in FIG. 3 as well, allowing the frame 103 to be lightweight to maneuver and assemble. FIG. 4 shows a rear side elevational view of the current disclosure. In one embodiment, a corner bracket 143 couples each leg 125 to another, concealed within the hollow space 121 of the legs 125 (shown in FIG. 2). Connectors 149 are shown that fasten the corner bracket 143 (concealed within frame 103) in place through holes 141 in each leg 125 corner to hold the assembled frame 103 together. Leg 125*a* is shown coupled to legs 125*b* and 125*d*, Leg 125*b* is shown coupled to leg 125*c*, and leg 125*c* is shown coupled to leg 125*d*.

The legs 125 can be coupled via connectors 149 to form an integral frame 103, as shown in FIG. 4. Thus, frame 103 can form a polyhedron, for example, but not limited to, a cuboid as shown in FIGS. 1*a-b* and 4. A polyhedron as used herein is defined as a solid figure with many plane faces. A cuboid as used herein is defined as a solid that has six rectangular faces at right angles to each other. In one embodiment, a leg 125 can be curved and not straight to form a curved frame 103 (not shown). Thus, integral frame 103 may form a shape that has curves well. The frame 103 and panels 130 can remain stationary, and do not need to be opened or disassembled to remove or replace a removable panel 130. In FIG. 4, the back face 105 of the removable panel 130 is shown, and the connectors 129 can be seen at each midpoint of each leg 125 of the frame 103, fastened through the holes 127 in each clip and through the holes 145 in each leg 125.

The panel 130 can be removed by unscrewing connectors 129 that secure clips 115 of panel 130 to frame 103. A force can be applied to the interior face 105 of panel 130, pushing out panel 130 in the direction of its exterior face 106. To replace the removed panel 130, a new panel 130 can be inserted through the exterior face 106 of the panel 130 until it rests against the frame 103, and until the lip 113 substantially conceals and blocks access to the edges 133 of panel set 130 once again. Clips 115 can then be inserted into second channel 119, and screws 129 inserted into the clip hole 127 to fully secure the panel 130 to the frame 103.

It will be appreciated that various of the above-disclosed embodiments and other features and functions, or alternatives thereof, may be desirably combined into many other different systems or applications. Also that various presently unforeseen or unanticipated alternatives, modifications, variations or improvements therein can be subsequently made by those skilled in the art which are also intended to be encompassed by the following claims.

What is claimed is:

1. A cabinet door system with a modular frame forming a bottom, sides, a top, and portion of a front of the system and a removable panel forming portions of a front and a back of the system, the cabinet door system comprising:

a. a modular frame comprising:

a plurality of frame legs, each leg of the plurality of frame legs having:

opposing ends;

a back section;

a lip having a bottom, sides, and a front section of each said frame leg, the lip extending along an entire length of the frame leg between the opposing ends of the frame leg, and having a width extending between a front face of the frame leg and an inner surface of the back section of the frame leg;

a first channel; and at least two second channels, the first channel extending between the lip front section and a back section of the frame leg, the at least two second channels positioned within portions of the first channel of the frame leg, and the plurality of frame legs connected to one another at respective ends, forming a closed perimeter of a polygonal integral frame;

b. the removable panel having a polygonal front face and an opposing back face, a thickness that is a difference between the front face and the back face of the removable panel, a plurality of edges forming a perimeter of the panel extending between the front face and the back face of the panel, each edge corresponding to a respective frame leg of the plurality of frame legs, the removable panel being configured to be installed in the closed perimeter of connected frame legs, each respective edge of the panel being positioned within the first channel of a corresponding frame leg for installing the panel in the polygonal integral frame, the first channel sized to accommodate the removable panel, such that the removably installed panel within the corresponding frame legs is removable through the front face of the polygonal integral frame in response to pressure applied to the back face of the panel, while the integral frame remains an integral closed polygon such that no portion of the integral frame is detached when the panel is removed through the front face of the integral frame, the lip forming an L shaped profile with the back section of the frame leg, such that the length of the lip extends from one end of a frame leg to the opposing end of the frame leg, and the width of the lip extending from the front face of the removable panel, across the thickness of the panel edges, to the back face of the removable panel, such that the lip meets the back section of the frame leg perpendicularly, and such that the back section of the frame leg overlaps to the back face of the panel, covering ¾ inches to 3 inches of the perimeter of the panel's back face, wherein the lip is sufficient to conceal the removable panel edges and for a front portion of the lip to be exposed such that the front of the lip is flush with the front face of the removable panel, the portion of the lip exposed being a front face of the integral frame and a portion of the front face of the cabinet door system; and c. a plurality of clips coupled to each of the edges of the removable panel, corresponding to the at least two second channels, such that when the removable panel is installed in the first channel, each clip of the plurality of clips is positioned within a respective second channel of each of the respective legs, the second channel sized and recessed within the corresponding frame leg to accommodate the clip, such that when the panel is installed and removably secured within the frame leg, each clip is removably attached to/within the respective second channel of the frame leg, preventing the panel from falling out, and such that when the removable panel is positioned within in the first channel, and the plurality of clips are positioned but not removably attached to the frame within the respective second channels, the removable panel falls out of the front face of the integral frame when pressure is applied to the back face of the removable panel, and wherein the polygonal integral frame maintains its closed perimeter, with no portion of the frame being removed for the removal of the removable frame.

2. The cabinet door of claim 1, wherein the frame legs of the integral frame polygon comprises the first shallow channel, and the second deeper channel contained within the first channel.

3. The cabinet door of claim 1, wherein the frame legs of the integral frame comprises a first hole corresponding to the second channel of the frame legs of the integral frame.

4. The cabinet door system of claim 1, wherein the first channel has a height and a width, and at least one of said height or width of said first channel exceeds either the height or width of said removable panel by a predetermined amount.

5. The cabinet door system of claim 1, wherein said first channel has a height and a width, and at least one of said height or width of said first channel exceeds either the height or width of said removable panel by a tolerance of 0.125 of an inch to allow for the removal of said panel from said first channel.

6. The cabinet door system of claim 1, wherein said second channel has a height and a width, and at least one of said height or width of said second channel exceeds either the height or width of said clip by a predetermined amount.

7. The cabinet door system of claim 1, wherein said second channel has a height and a width, and at least one of said height or width of said second channel exceeds either the height or width of said clip by a tolerance of 0.03125 of an inch to allow for the removal of said clip from said second channel.

8. The cabinet door system of claim 1, wherein said plurality of frame legs comprises four frame legs.

9. The cabinet door system of claim 8, wherein said plurality of frame legs form a parallelogram when assembled, coupled to one another via corner brackets and screws at each corner to enclose a removable panel.

10. The cabinet door system of claim 1, wherein only the front face of said removable panel and lip that is flush with front face of panel are the exposed parts of cabinet door when said cabinet door is in a closed position and when viewed head on from said front face.

11. The cabinet door system of claim 1, wherein said lip comprises four surfaces, a first surface touching and flanking edges of a side of said removable panel, a second opposing top surface, a third front and exposed surface that is flush with front face of said panel, and a fourth beveled side adjoining said opposing top surface of lip and said front exposed front surface of lip.

12. The cabinet door system of claim 11, wherein the frame legs of the integral frame comprises polygonal members defining a first hole on an opposing side of the legs corresponding to the second channel, the first hole allocating a space for a top cylindrical structure having threading and defining a second hole on the face of the plurality of clips coupled to the removable panel, and opposing the side of the clips coupled to the removable panel and positioned in the second channels, the second hole threading of the clips corresponding to a fastener, and the fastener fastening the clips into the second channels.

13. The cabinet door system of claim 12, wherein said polygonal members of the frame defining a hole hold a fastener in place when said frame legs are assembled as a closed integral frame and said removable panel is coupled to the plurality of clips and fastened to the integral frame.

14. The cabinet door system of claim 13, wherein said first channel encompasses a width, length, and depth of said second channel within a width, length, and depth of said first channel.

* * * * *